United States Patent [19]

Ranz et al.

[11] 4,315,070

[45] Feb. 9, 1982

[54] COLOR-PHOTOGRAPHIC RECORDING MATERIAL CONTAINING A HIGHLY REACTIVE DIR-COUPLER

[75] Inventors: Erwin Ranz, Leverkusen; Joachim W. Lohmann, Odenthal; Heinz-Dieter Schütz, Bergisch-Gladbach, all of Fed. Rep. of Germany

[73] Assignee: Agfa-Gevaert Aktiengesellschaft, Leverkusen, Fed. Rep. of Germany

[21] Appl. No.: 158,990

[22] Filed: Jun. 12, 1980

Related U.S. Application Data

[63] Continuation of Ser. No. 16,954, Mar. 2, 1979, abandoned.

[30] Foreign Application Priority Data

Dec. 11, 1978 [DE] Fed. Rep. of Germany ..... 2853362

[51] Int. Cl.[3] ..... G03C 1/40

[52] U.S. Cl. ..... 430/505; 430/544; 430/957

[58] Field of Search ..... 430/505, 544, 957

[56] References Cited

U.S. PATENT DOCUMENTS

| | | | |
|---|---|---|---|
| 3,958,993 | 5/1976 | Fujiwhara et al. | 430/505 |
| 4,046,574 | 9/1977 | Odenwalder et al. | 430/544 |
| 4,052,213 | 10/1977 | Credner et al. | 430/443 |
| 4,088,491 | 5/1978 | Odenwalder et al. | 430/505 |
| 4,133,687 | 1/1979 | Chen et al. | 430/617 |

FOREIGN PATENT DOCUMENTS

| | | |
|---|---|---|
| 2448063 | 4/1976 | Fed. Rep. of Germany . |
| 2707489 | 8/1978 | Fed. Rep. of Germany . |
| 2709688 | 9/1978 | Fed. Rep. of Germany . |

*Primary Examiner*—Travis Brown

*Attorney, Agent, or Firm*—Connolly and Hutz

[57] ABSTRACT

In high sensitivity color photographic recording materials the undesired color fog density is reduced by highly reactive DIR-compounds having an effective reaction velocity constant $k_{eff}$ of more than 20,000 [1 . mole$^{-1}$ . sec$^{-1}$] (measured at pH 10.2 by the method described hereinafter) in a concentration of from $10^{-5}$ to $10^{-3}$ mole per mole of silver halide, if contained in a light-sensitive silver halide emulsion layer or in a concentration of from $10^{-7}$ to $10^{-5}$ mole per gram of solids if contained in a silver-halide-free binder layer adjacent to a silver halide emulsion layer.

3 Claims, 2 Drawing Figures

COLOR-PHOTOGRAPHIC RECORDING MATERIAL CONTAINING A HIGHLY REACTIVE DIR-COUPLER

CROSS REFERENCE TO PARENT APPLICATION

This application is a continuation of application Ser. No. 16,954 filed Mar. 2, 1979, now abandoned, for Colour-Photographic Recording Material Containing A Highly Reactive DIR-Coupler.

This invention relates to a colour-photographic recording material which contains small quantities of a DIR-coupler of extremely high reactivity.

It is known that compounds which release development inhibitors on reaction with colour developer oxidation products can be incorporated in photographic recording materials. Compounds such as these are, for example, the so-called DIR-couplers (DIR=Development-Inhibitor-Releasing) described in U.S. Pat. No. 3,227,554 or the so-called DIR-compounds described in U.S. Pat. No. 3,632,435.

The above mentioned DIR couplers or DIR-compounds contain in the coupling position, a thioether substituent which, during colour coupling, is split off in the form of a diffusing mercapto compound which has development-inhibiting properties and which is therefore capable of influencing further development of the silver halide. By using DIR-couplers or DIR-compounds of the type in question, the properties of photographic materials are improved in many respects. Thus, it is possible to control graininess, definition and gradation and, in this way and by utilising the so-called interimage effect, considerably to improve the overall colour reproduction.

In this connection, reference is made to the article entitled "Development-Inhibitor-Releasing (DIR) Couplers in Color Photography" in "Photographic Science and Engineering" 13, 74 (1969).

Known DIR-couplers automatically give a dye together with the development inhibitor released. By constrast, the so-called DIR-compounds, such as those described in the above mentioned U.S. Pat. No. 3,632,345 and those described in German Offenlegungsschriften Nos. 2,359,295 corresponding to U.S. Pat. No. 3,958,993; 2,405,442 corresponding to U.S. Pat. No. 3,961,959; 2,502,892 corresponding to U.S. Pat. No. 4,046,574; 2,540,959 corresponding to U.S. Pat. No. 4,088,491; 2,552,505; 2,707,489 corresponding to allowed U.S. Application Ser. No. 878,238, filed Feb. 16, 1978 (now U.S. Pat. No. 4,183,752); and 2,709,688 corresponding to U.S. Application Ser. No. 882,631 filed Mar. 2, 1978 (now U.S. Pat. No. 4,186,012), do not give any coloured compounds on reaction with oxidised colour developers. However, since the DIR-compounds, just mentioned also enter into a coupling reaction, although only to form substantially colourless products, they are also referred to hereinafter as DIR-couplers.

One familiar problem in photographic chemistry is that of establishing an optimal relationship between the sensitivity and fogging of a photographic emulsion. It has been found that sensitivity-increasing agents and measures frequently result in an increase in fogging. On the other hand, the use of fog-reducing stabilisers generally involves a loss in sensitivity. Accordingly, this situation may be described as a genuine dilemma.

Measures for reducing the fogging of photographic emulsions which have no significant effect upon their sensitivity include the establishment of optimal precipitation and ripening conditions and the addition of certain stabilisers, such as tetraazaindene derivatives or heterocyclic mercapto compounds, some of which may even produce an increaase in sensitivity in combination with certain sensitising dyes. Another measure is to use so-called masked stabilisers which only release the active stabilising compounds when the pH-value is increased, i.e. during photographic development, and in this way favourably influence the formation of development fog.

It is obvious that, in seeking increasingly more sensitive photographic recording material, the expert will consider any measure which promises an increase in sensitivity without, at the same time, increasing fogging. Conversely, the only fog-reducing agents which may be considered for use are those which have little or no effect on sensitivity. In the case of colour-photographic recording materials, fogging occurs in the form of a colour fog. In the case of negative recording materials, this colour fog increases the so-called copying density, and, as a result, necessitates an increase in the intensity of exposure or a longer exposure time during the copying process. It goes without saying that a colour fog is completely undesirable in colour photographic reversal materials because of the adverse effect which it has upon the white areas of the image.

An object of the present invention is to provide a colour photographic recording material which, in at least one of its layers, contains agents for reducing colour fogging without, at the same time, impairing the other sensitometric properties, particularly gradation and sensitivity.

It has now been found that colour fogging can be reduced by the use of DIR-couplers, providing the DIR-couplers used show extremely high reactivity and are used in extremely low concentrations in particular in such low concentrations that they have substantially no effect on the gradation or sensitivity.

The present invention relates to a colour photographic recording material containing at least three differently spectrally sensitised silver halide emulsion layer units and non-diffusing dye components associated therewith, characterised in that, in at least one of its layers, it contains a DIR-coupler having an effective reaction velocity constant $k_{eff}$ of more than 20,000 [$l.mole^{-1}.sec^{-1}$] (as measured at pH 10.2 by the method described hereinafter) in a concentration of from $10^{-5}$ to $10^{-3}$ mole per mole of silver halide in the same layer or in a concentration of from $10^{-7}$ to $10^{-5}$ mole per gram of solids in the case of a silver-halide-free binder layer adjacent a silver halide emulsion layer.

The colour photographic recording materials normally contain one silver halide emulsion layer unit for recording light of each of the three spectral regions red, green and blue. To achieve this the light sensitive layers are spectrally sensitised in known manner by suitable sensitising dyes. The blue-sensitive silver halide emulsion layer unit does not necessarily have to contain a spectral sensitiser because, in many cases, the intrinsic sensitivity of the silver halide is sufficient for recording blue light.

Each of the above-mentioned silver halide emulsion layer units may contain a single silver halide emulsion layer or, in known manner, as for example in the so-called double layer arrangement, two or even more silver halide emulsion layers (German Pat. No. 1,121,470). The red-sensitive silver halide emulsion layer unit is normally arranged nearer the support layer than the green-sensitive silver halide emulsion layer unit which in turn is arranged nearer the support layer than the blue-sensitive silver halide emulsion layer unit, a light-insensitive yellow filter layer generally being arranged between the green-sensitive and blue-sensitive layer. However, other arrangements are also possible. A light-insensitive intermediate layer which may contain agents for suppressing unwanted diffusion of developer oxidation products is generally arranged between layers of different spectal sensitivity. In cases where a silver halide emulsion layer unit contains several silver halide emulsion layers of the same spectral sensitivity, these emulsion layers may be arranged immediately adjacent to one another or in such a way that a light-sensitive layer of different spectral sensitivity is situated between them as described in German Offenlungsschriften Nos. 1,958,709; 2,530,645 and 2,622,922.

The non-diffusing dye components associated with the light-sensitive silver halide emulsion layer units may in principle be non-diffusing compounds of any type from which image dyes having the required spectral and sensitometric properties can be produced by suitable treatment (development). For example, they may be so-called dye-providing compounds which may be incorporated in the layers in non-diffusing form and from which diffusing image dyes may be released during photographic development and transferred to an image-receiving layer. However, a non-diffusing colour coupler which is capable of reacting with colour developer oxidation products to form a non-diffusing dye is preferably associated with each of the above-mentioned light-sensitive silver halide emulsion layers. The non-diffusing colour couplers are preferably accommodated in the light-sensitive layer itself or in close proximity thereto.

The colour couplers which may be associated with the two or more component layers having the same spectral sensitivity do not necessarily have to be identical. The only requirement is that, on colour development, they should give the same colour, normally a colour which is complementary to the colour of the light to which the light-sensitive silver halide emulsion layers are sensitive. Accordingly, at least one non-diffusing colour coupler for producing the cyan component colour image, generally a coupler based on phenol or α-naphthol, is associated with each of the red-sensitive silver halide emulsion layers. Each of the green-sensitive silver halide emulsion layers has associated with it at least one non-diffusing colour coupler for producing the magenta component colour image, colour couplers based on 5-pyrazolone or indazolone normally being used. Finally, each of the blue-sensitive silver halide emulsion layers has associated at least one non-diffusing colour coupler for producing the yellow component colour image, generally a colour coupler containing an open-chain ketomethylene group. Large numbers of colour couplers of this type are known and are described in a number of Patent Specifications. By way of example, reference is made at this juncture to the publications "Farbkuppler" by W. Pelz in "Mitteilungen aus den Forschungslaboratorien der Agfa, Leverkusen/Munich", Vol. III, page 111 (1961) and K. Venkataraman in "The Chemistry of Synthetic Dyes", Vol. 4, p. 341 to 387, Academic Press (1971).

The colour couplers may be both standard 4-equivalent couplers and also 2-equivalent couplers in whose case a smaller quantity of silver halide is required for dye formation. 2-Equivalent couplers are known to be derived from the 4-equivalent couplers in that, in the coupling position, they contain a substituent which is split off during the coupling reaction. The 2-equivalent couplers which may be used in accordance with the invention include both those which are substantially colourless and also those having a strong natural colour which disappears during the colour coupling reaction or is replaced by the colour of the image dye produced. According to the invention, couplers of the second type may additionally be present in the light-sensitive silver halide emulsion layers where they act as masking couplers for compensating the undesirable secondary densities of the image dyes. The 2-equivalent couplers also include the known white couplers which do not give any dye on reaction with colour developer oxidation products. The 2-equivalent couplers further include the known DIR-couplers, i.e. couplers which, in the coupling position, contain a releasable radical which, on reaction with colour developer oxidation products, is released in the form of a diffusing development inhibitor.

If necessary, it is possible to use mixtures of colour couplers in order to obtain a required colour or a required reactivity. For example, water-soluble couplers may be used in combination with hydrophobic water-insoluble couplers.

According to the invention, at least one layer of the colour photographic recording material contains a DIR-coupler of extremely high reactivity. In the context of the invention, reactivity is expressed as an effective reaction velocity constant $k_{eff}$. The DIR-couplers used in accordance with the invention have an effective reaction velocity constant $k_{eff}$ of more than 20,000 $l.mole^{-1}.sec^{-1}$ and, in this respect, differ very considerably from the DIR-couplers hitherto used in practice which have effective reaction velocity constants of from 1000 to 8000 [$l.mole^{-1}.sec^{-1}$]. These reactive DIR-couplers may for example be contained in a light-sensitive silver halide emulsion layer in a quantity of from $10^{-5}$ to $10^{-3}$ mole per mole of silver halide. However it is also possible to incorporate these reactive DIR-couplers in a light-insensitive binder layer adjacent to a light-sensitive layer, provided that this light-insensitive binder layer does not contain any silver halide. In this connection, it is pointed out that light-insensitive, very fine-grained silver halide, for example having a grain size of less than 0.2 μm is occasionally incorporated in binder layers adjacent to light-sensitive silver halide emulsion layers in order to improve the photographic properties of the recording material, for example its sensitivity. Since improvements such as these in the photographic properties are not obtained or may even be overcompensated where the reactive DIR-couplers are also present in the DIR-couplers are, according to the invention, added only to light-insensitive binder layers which are completely free from silver halide. The reactive DIR-couplers are added to the light-insensitive binder layers, usually gelatin layers, in quantities of from $10^{-7}$ to $10^{-5}$ mole per gram of solids.

The reduction in colour fogging obtained in accordance with the present invention cannot be obtained with the hitherto used DIR-couplers, at least not without adversely affecting the other sensitometric properties. The hitherto used DIR-couplers were employed primarily for their grain-refining and gradation-reducing effect. To this end, they have to be used in sufficiently high concentrations to be able to compete successfully with the colour coupler simultaneously present for the developer oxidation product. A reduction in colour fogging by the use of DIR-couplers without unfavourable effects upon the other sensitometric data has hitherto never been observed. According to the invention, this is for the first time made possible by the use of DIR-couplers of extremely high reactivity in low concentrations. In this way, colour fogging is distinctly reduced, whilst all of the other effects hitherto obtained when using DIR-couplers, such as grain refinement, reduction of gradation and influence on the interimage effect, are hardly observed on account of the highly reactive DIR-couplers in the materials according to the invention. The greatest reduction in fogging is generally obtained with highly reactive DIR-couplers of the type which form, on coupling, only substantially colourless reaction products, so that compounds such as these are particularly preferred for the purposes of the invention.

It goes without saying that also other DIR-couplers of the usual reaction velocity may be present in the colour photographic material of the invention for attaining the other effects such as grain refining, reduction of gradation and inter image effects that are usually attained with DIR-couplers.

DIR-couplers having the high effective reaction velocity constants according to the invention may be found in virtually any class of compounds known as DIR-couplers. In this connection, reference is made for example to the publications already mentioned (on page 2). However, it must be pointed out that in this connection there is no question whatever of a particular chemical constitution, the DIR-couplers used in accordance with the invention instead merely being required to show the necessary high effective reaction velocity constant of more than 20,000 [$l.mole^{-1}.sec^{-1}$]. The reactivity of the DIR-couplers may readily be determined by the method described hereinafter and all that the expert has to do is to select from the classes of compounds known from the above mentioned publications those compounds which have the necessary high effective reaction velocity constant.

It has been found that the relative reaction velocity constant of DIR-coupler determined by any of the known methods can assume different values, depending on how the DIR-coupler is dispersed. Thus, it is possible for the same DIR-coupler to be used both in the form of an aqueous alkaline solution and also in the form of an emulsion using a so-called coupler solvent or oil former. Hydrophobic DIR-couplers may be used in the form of aqueous dispersions, which may optionally be prepared with low-boiling organic solvents, or even in the form of the above-mentioned emulsions. In the case of emulsions, the $k_{eff}$-value may in addition be determined by the nature and quantity of the solvent (oil former) and by the type of wetting agent used and the size of the droplets. For this reason, it is desirable directly to resort to the effective reaction velocity constant ($k_{eff}$) of the DIR-coupler in its particular dispersion form as the criterion for assessing the suitability of the DIR-coupler for the purposes of the invention. Accordingly, it is best, even for determining the relative reaction velocity, to use the DIR-coupler in the same dispersion form in which it is also to be used in the colour photographic material.

An electromechanical process has been developed with the purpose of allowing the reactivity of dissolved or emulsified couplers to be determined substantially in vitro in the form of an effective reaction velocity constant $k_{eff}$[$l.mol^{-1}.sec^{-1}$]. A measure of reactivity is the consumption of the developer oxidation product which can be determined by measuring the redox potential in a "stopped-flow" apparatus. The $k_{eff}$-values quoted in the description were determined by the method described in the following.

The construction and mode of operation of the measuring apparatus used are described in the following with reference to the accompanying drawings, wherein.

Figure 1:
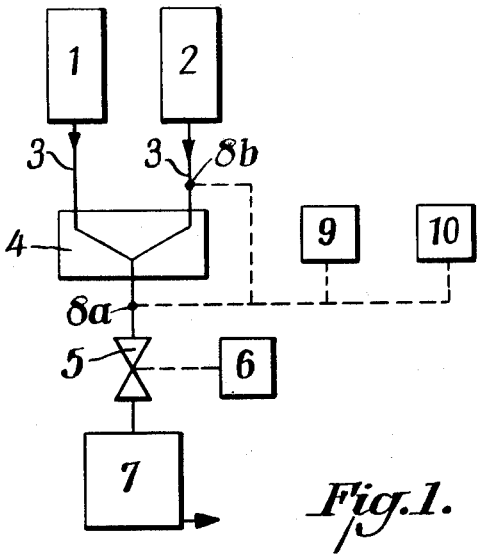
FIG. 1 is a basic diagram of the measuring apparatus.

The measuring apparatus shown in FIG. 1 consists of cylindrical reservoirs 1 and 2 (approximately 25 cm tall), feedpipes 3 equipped with non-return valves, a mixing chamber 4, a magnetic valve 5, which is closed in its rest position and which can be opened through a pulse generator 6, a collecting vessel 7, in which a reduced pressure is generated and maintained, a measuring electrode 8*a*, a reference electrode 8*b*, a digital mV-meter 9 and a recorder 10.

By means of the pulse generator 6, the magnetic valve 5 is opened for a period $t_o$. Due to the pressure gradient between the collecting vessel 7 and the reservoirs 1 and 2, the liquids contained in the reservoirs flow through the feedpipes 3 into the mixing chamber where they are intensively mixed. The mixture then flows through the magnetic valve 5 into the collecting vessel 7. The reservoir 1 contains an oxidising agent, for example a $0.5\times10^{-3}$ molar aqueous solution of $K_3[Fe(CN)_6]$.

The reservoir 2 contains a colour developer, the coupler to be studied and agents for adjusting a desired pH-value (buffers), all in aqueous solution.

To this end, 30 ml of the ready-to-use colour developer solution described in "The British Journal of Photography", 12 pages 597 and 598 (1974), the developer being 2-methyl-N-ethyl-N-hydroxyethyl-p-phenylene diamine, were mixed with an aqueous solution or dispersion of $2.10^{-3}$ moles of the DIR-coupler to be studied. Couplers which are not soluble in water may be used in the form of an emulsion prepared in known manner from the coupler, a coupler solvent and a hydrophilic binder. In the present case, gelatin was used as the binder. In any event, gelatin was added so that the total gelatin content amount to 10 gram. The mixture was made up with water to 1000 ml and the pH-value adjusted to 0.2 with a carbonate/hydrogen carbonate buffer. The measuring temperature was 20° C. Minor changes in the concentrations of the oxidising agent, the developer, the coupler or the binder are permissible, and do not significantly affect the measurement results.

The redox potential of the mixture is measured by the measuring electrode 8*a* (1 mm diameter platinum wire). The reference electrode 8*b* is an Ag/AgCl-electrode (for example an Argenthal cartridge), which, in this embodiment, is situated in the feedpipe leading from the reservoir 2 to the mixing chamber, but which may also be arranged in the usual way adjacent to the platinum electrode. The measured redox potential of the mixed solutions may be read off from the digital mV-meter 9 and recorded as a function of time by means of the recorder 10 (compensation recorder, oscillograph, light-spot line recorder).

Figure 2:
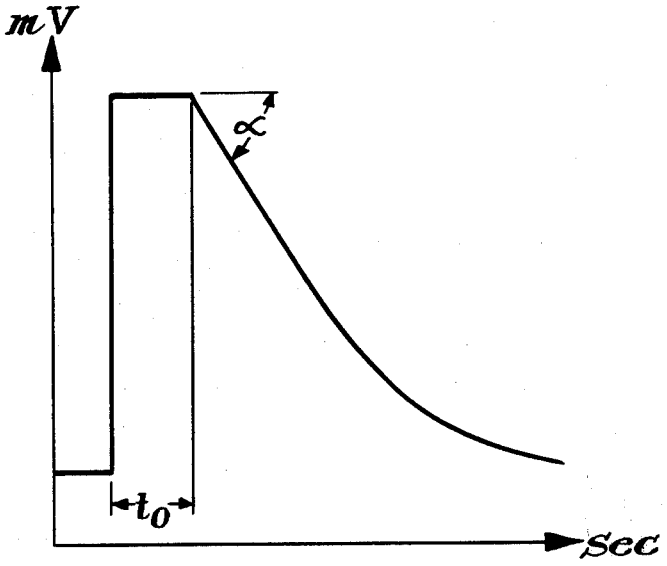
FIG. 2 shows a graph obtained by means of this measuring apparatus for determining a $k_{eff}$-value.

The change in the redox potential as a function of time is shown in FIG. 2. The measured redox potential in mV (ordinate) is recorded as a function of time in seconds (abscissa). $t_o$ represents the open period of the magnetic valve. The effective reaction velocity constant $k_{eff}$ may be calculated from the angle $\alpha$ in accordance with the following equation:

$$k_{eff} = \frac{1}{K_o \cdot f} (tg\alpha_K - tg\alpha_O)$$

in which:

$k_{eff}$=reaction velocity constant [$l.mole^{-1}.sec^{-1}$]
$K_0$=initial concentration of coupler [$mole.l^{-1}$]
f=electrochemical constant $$\left(f = \frac{R \cdot T}{n \cdot F}\right)$$

$\alpha_K$=angle $\alpha$ obtained when coupler is present
$\alpha_0$=angle $\alpha$ obtained when no coupler is present.

After the solutions have been introduced into the reservoir 1 and 2, the mixing chamber 4 and the inlet and outlet pipes are rinsed vigorously by prolonged opening of the magnetic valve 5, after which the reservoirs are restored to their original levels. The potential-time curve shown in FIG. 2 may be recorded by briefly opening the magnetic valve 5. The angle $\alpha$ (FIG. 2) between the time axis and the tangent to the measuring curve at the beginning of the reaction is determined once with the coupler to be measured ($\alpha_K$) and once without the coupler ($\alpha_0$). By introducing the two $\alpha$-values into the above equation, it is possible to determine the effective reaction velocity constant $k_{eff}$.

The method may of course also be modified in many ways. It is thus possible to use other colour developers and to carry out the reaction at other pH-values. For measuring the reactivity of couplers which are oxidised very rapidly by ferricyanide, the apparatus may be modified in such a way that, instead of a single mixing chamber 4, a system of two mixing chambers arranged one behind the other is used. In this case, the developer oxidation product is produced in the first mixing chamber by mixing developer and ferricyanide together, the resulting mixture being mixed with the coupler to be measured in the second mixing chamber. The measuring electrode primarily measures the concentration of colour developer oxidation product, presumably the quinone diimine of the corresponding colour developer used. So far as the basic principles of redox measurements are concerned, reference is made for example to J. Eggers "Uber die Folgereaktionen bei der Oxidation von p-Amino-N-dialkylanilinen" in "Mitteilungen aus den Forschungslaboratorien der Agfa", Vol. III, page 73 (1961).

The layer structure described in the following is used as a basis for explaining the invention. To this end, the above-mentioned layers are applied in the order specified to a transparent support layer. The quantities specified are based on 1 square meter in each case. The amounts of silver used in the layers are expressed by the corresponding quantities of silver nitrate.

1. A relatively low-sensitivity red-sensitive layer of a red-sensitized silver bromide iodide emulsion (5 mole % AgI) of 3.0 g of $AgNO_3$ with 790 mg of a cyan coupler corresponding to the formula

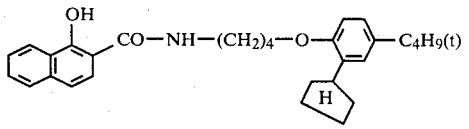

25 mg of a DIR-coupler corresponding to the formula

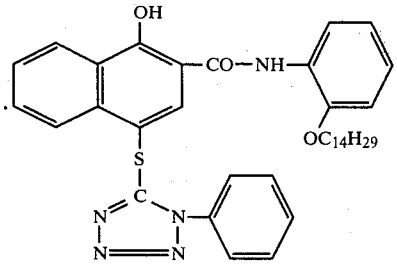

and 1.6 g of gelatin.

2. An intermediate layer of 0.7 g of gelatin.

3. A relatively low-sensitivity green-sensitive layer of a green-sensitized mixture of a relatively sensitive silver bromide iodide emulsion (5 mole % of AgI) of 1.5 g of $AgNO_3$ and a relatively non-sensitive silver bromide iodide emulsion of 1.9 g of $AgNO_3$ with 600 mg of a magenta coupler corresponding to the formula

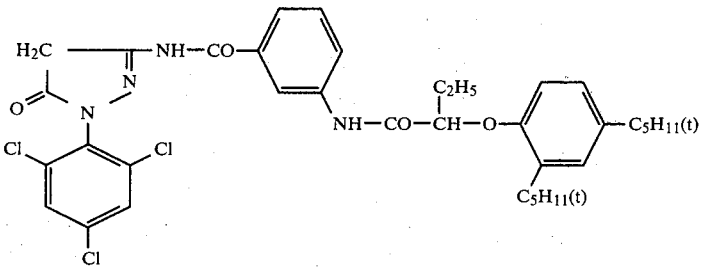

60 mg of a DIR coupler corresponding to the formula

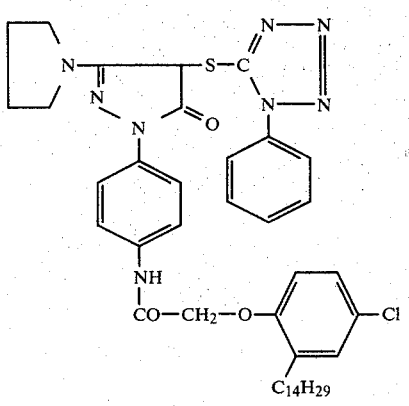

80 mg of a masking coupler corresponding to the formula

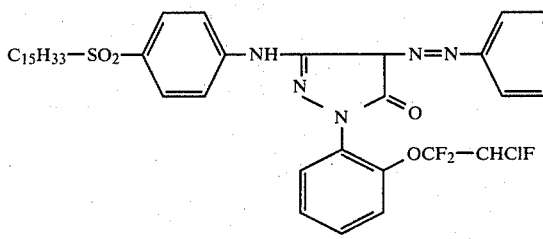

and 2.0 g of gelatin.

4. An intermediate layer of 0.7 g of gelatin.

5. A high-sensitivity red-sensitive layer of a red-sensitized silver bromide iodide emulsion (5 moles of AgI) and 2.0 g of $AgNO_3$ with 250 mg of the cyan coupler of layer 1 and 1.0 g of gelatin.

6. An intermediate layer of 0.7 gelatin, very fine-grained silver chloride (mean grain size less than 0.1 μm) of 0.34 g of $AgNO_3$ and 76 mg of a DIR coupler corresponding to the formula

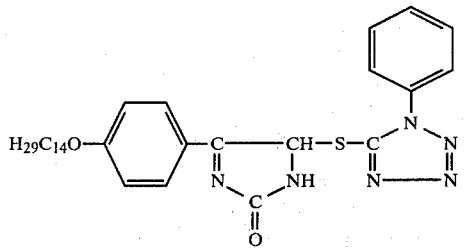

7. A high-sensitivity green-sensitive layer of a green-sensitised silver bromide iodide emulsion (7 mole % of AgI) of 2.8 g of $AgNO_3$ with 170 mg of a magenta coupler corresponding to the formula

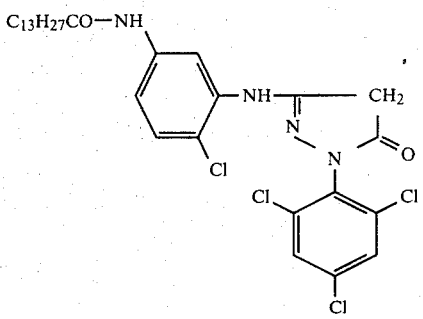

37 mg of a magenta coupler corresponding to the formula

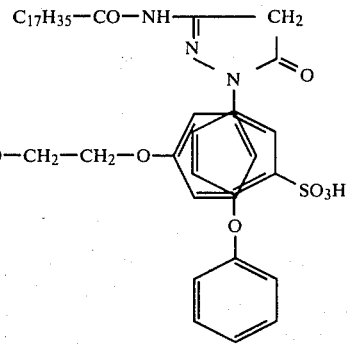

and 2.1 g of gelatin.

8. An intermediate layer of 0.7 g of gelatin.

9. A yellow filter layer containing colloidal silver for producing a yellow density of 0.8.

10. A blue-sensitive layer of a mixture of a sensitive silver bromide iodide emulsion (9 mole % of AgI) of 1.0 g of $AgNO_3$ and a relatively non-sensitive silver bromide iodide emulsion (3 mole % of AgI) of 0.6 g of $AgNO_3$ with 1.0 g of a yellow coupler corresponding to the formula,

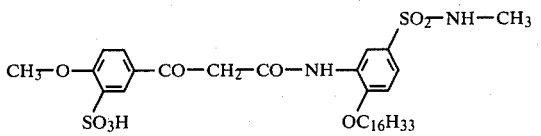

and 2.0 g of gelatin.

11. A surface layer of 0.7 g of gelatin.

Development is carried out in a high-temperature processing such as described in "The British Journal of Photography", 12, pages 597 and 598 (1974). In the following Examples, sensitivity is expressed in relative log I.t-units, as measured at 0.2 density units above the fog.

The interimage effects are defined as follows:

$$IIE=(\gamma_s-\gamma_w)/\gamma_w \cdot 100[\%]$$

s: selective exposure (green or red)

w: white exposure $\gamma_1$ is the gradation section of the characteristic curve which extends from the photosensitivity point (D=0.2 above fog) to an exposure value higher by 0.8 log I.t-units. That section which extends from this end point to an exposure value higher by another 0.8 I.t-units is called $\gamma_2$.

A compound of the following formula (DIR coupler A)

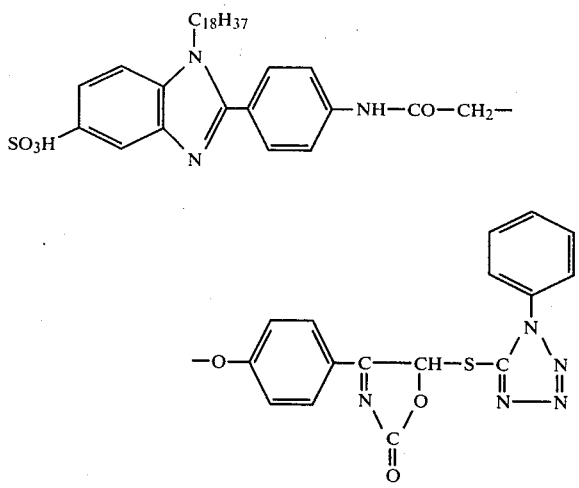

is used in the following as an example of a DIR-coupler according to the invention (reaction velocity constant > 2000 $l.mole^{-1}.sec^{-1}$).

DIR coupler A has an effective reaction velocity constant of 5000 $l.mole^{-1}.sec^{-1}$, as measured by the method described above.

DIR couplers B and C were also used for comparison. DIR coupler B is a compound corresponding to the following formula:

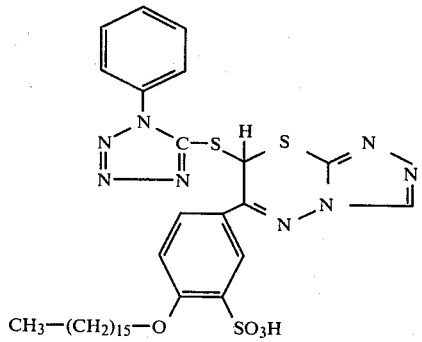

and has an effective reaction velocity constant of 3000 $l.mole^{-1}.sec^{-1}$.

DIR Coupler C is identical with the DIR coupler used in layer 1 ($k_{eff}$=7000 $l.mole^{-1}.sec^{-1}$).

DIR couplers A and B are dissolved according to the following formulation:

10 g of DIR coupler are made into a paste with 40 ml of methanol and adjusted to pH 10 with 0.1 n NaOH at a temperature of 50° C. After stirring until dissolution is complete, the pH-value is restored to 6.5 by the addition of 0.01 n $H_2SO_4$.

Coupler C is emulsified according to the following formulation:

A solution of 10 g of DIR coupler C in 10 g of dibutyl phthalate, 30 ml of ethyl acetate and 5 g of dimethyl formamide is emulsified with intensive mixing (mixing siren) into a solution of 100 ml of a 5% aqueous gelatin solution and 0.8 g of Mersolat (wetting agent, sulphonated paraffin hydrocarbons). The ethyl acetate is then evaporated off.

EXAMPLE 1

Partial structure; only layer 3 and, above it, layer 7 on a transparent support layer. Layer 7 additionally contains DIR coupler A in increasing quantities, as shown in Table 1 below:

TABLE 1

| DIR coupler A [mole/mole Ag] | $\gamma_1/\gamma_2$ magenta | Sensitivity magenta | Fog magenta |
|---|---|---|---|
| without DIR coupler | 0.85/0.79 | 40.3 | 0.55 |
| $1.52 \cdot 10^{-5}$ | 0.86/0.76 | 40.2 | 0.55 |
| $6.07 \cdot 10^{-5}$ | 0.86/0.80 | 40.1 | 0.53 |
| $1.21 \cdot 10^{-4}$ | 0.86/0.81 | 40.1 | 0.50 |
| $2.42 \cdot 10^{-4}$ | 0.90/0.81 | 40.0 | 0.45 |
| $3.03 \cdot 10^{-4}$ | 0.89/0.80 | 39.7 | 0.42 |

The magenta fog is reduced by 0.05 density units with $1.21.10^{-4}$ mole of DIR coupler A per mole of Ag without any significant change in gradation or sensitivity.

EXAMPLE 2

Overall structure; all layers 1 to 11. DIR coupler A is added to layer 7 in increasing quantities, as shown in Table 2 below:

TABLE 2

| DIR Coupler A [mole/mole Ag] | $\gamma_1/\gamma_2$ magenta | Sensitivity magenta | Fog magenta | IEE[%] magenta $\gamma_1/\gamma_2$ | IEE[%] cyan $\gamma_1/\gamma_2$ |
|---|---|---|---|---|---|
| without DIR compound | 0.80/0.63 | 40.0 | 0.90 | 15/32 | 25/27 |
| $6.07 \cdot 10^{-5}$ | 0.81/0.65 | 39.0 | 0.86 | 20/29 | 22/28 |
| $1.21 \cdot 10^{-4}$ | 0.82/0.66 | 40.1 | 0.85 | 18/30 | 23/30 |
| $1.82 \cdot 10^{-4}$ | 0.82/0.67 | 39.9 | 0.83 | 14/28 | 25/25 |
| $2.42 \cdot 10^{-4}$ | 0.83/0.66 | 39.8 | 0.82 | 15/29 | 22/25 |
| $3.03 \cdot 10^{-4}$ | 0.80/0.66 | 29..6 | 0.74 | 14/32 | 25/25 |

The addition of $1.82.10^{-4}$ mole of DIR coupler A per mole of Ag reduces magenta fogging without affecting sensitivity, gradation or the magenta and cyan interimage effects.

EXAMPLE 3

Layer 1 on a transparent support layer. A comparison is made between DIR coupler A with the high effective reaction velocity constant according to the invention and DIR couplers B and C with lower effective reaction velocity constants. Layer 1 already contains a certain quantity of DIR coupler C. However, Table 3 below shows only the additional quantities of the DIR coupler to be compared.

TABLE 3

| DIR Coupler [mole/mole Ag] | $\gamma_1/\gamma_2$ cyan | Sensitivity cyan | Fog cyan |
|---|---|---|---|
| without DIR coupler | 1.40/1.39 | 32.4 | 0.75 |
| A/1.82 . $10^{-4}$ | 1.38/1.37 | 32.3 | 0.62 |
| B/2.00 . $10^{-3}$ | 1.12/1.22 | 31.5 | 0.65 |
| C/2.30 . $10^{-3}$ | 1.15/1.46 | 31.4 | 0.60 |

The DIR coupler A according to the invention reduces the cyan fog by 0.13 density units. In order to obtain similar reductions in fogging with DIR couplers B and C which do not correspond to the invention, these DIR couplers have to be added in approximately 10 times the quantity with all the well-known adverse effects on gradation and sensitivity which this involves. By contrast, fogging can be reduced by the DIR couplers according to the invention without any change in gradation or sensitivity.

EXAMPLE 4

Overall structure; all layers 1 to 11. The DIR coupler is used in layers 9 (yellow filter layer) and 10 (blue-sensitive silver halide emulsion layer). The results obtained are set out in Table 4.

TABLE 4

| | Yellow | | | Magenta | | |
|---|---|---|---|---|---|---|
| DIR coupler A | Sensitivity | Fog | $\gamma_1/\gamma_2$ | Sensitivity | Fog | $\gamma_1/\gamma_2$ |
| No DIR coupler in layers 9 + 10 | 43.5 | 0.81 | 0.85/0.81 | 39.0 | 0.72 | 0.64/0.63 |
| In layer 9 4.2 . $10^{-6}$ m mole per g of solids | 43.3 | 0.75 | 0.81/0.085 | 39.2 | 0.67 | 0.68/0.63 |
| In layer 10 1.3 . $10^{-3}$ m mole per mole of Ag | 43.4 | 0.75 | 0.80/0.82 | | | |

The DIR coupler A in layers 9 and 10 produces a distinct reduction in yellow and magenta fogging, even in quantities which are not sufficient to reduce sensitivity or gradation.

We claim:

1. In a color photographic recording material comprising at least three differently spectrally sensitized light sensitive silver halide emulsion layer units which have non-diffusing color couplers associated therewith, and non-light-sensitive binder layers, the improvement according to which in at least one of the light-sensitive and light-insensitive layers of the recording material is associated with a DIR coupler compound corresponding to the following formula:

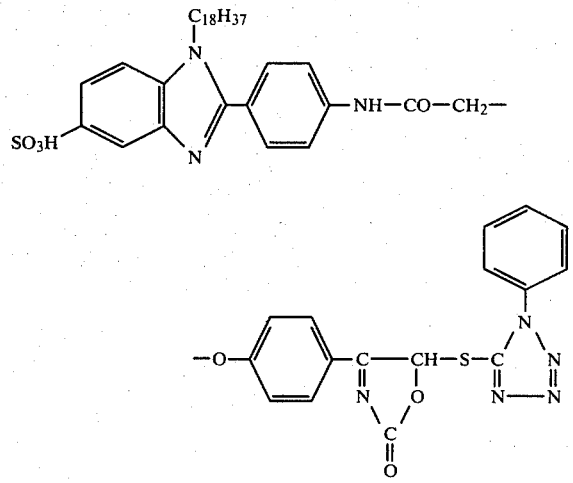

said DIR coupler having an effective reaction velocity constant $k_{eff}$ of more than 20,000 (mole$^{-1}$.sec$^{-1}$.) in a concentration of from $10^{-5}$ to $10^{-3}$ mole per mole of silver halide in the same layer or in a concentration of from $10^{-7}$ to $10^{-5}$ mole per gram of solids in the case of a silver-halide-free binder layer adjacent to a silver halide emulsion layer.

2. The recording material as claimed in claim 1, in which the DIR coupler used is a DIR coupler which forms, on coupling with the color developer oxidation products, only substantially colorless reaction products.

3. The recording material as claimed in claim 1 in which the DIR coupler having the specified effective reaction velocity constant $k_{eff}$ of more than 20,000 l.mole$^{-1}$.sec$^{-1}$ is contained in the yellow filter layer.

* * * * *

UNITED STATES PATENT AND TRADEMARK OFFICE

CERTIFICATE OF CORRECTION

PATENT NO. : 4,315,070

DATED : February 9, 1982

INVENTOR(S) : Ranz, et al

It is certified that error appears in the above-identified patent and that said Letters Patent is hereby corrected as shown below:

Column 6, first line, "electromechanical" should be deleted and -- electrochemical -- should be inserted.

Same column, line 52, the number "0.2" should be deleted and the figure -- 10.2 -- should be inserted.

Column 9, the second structural formula in the column and after line 18 should read as follows:

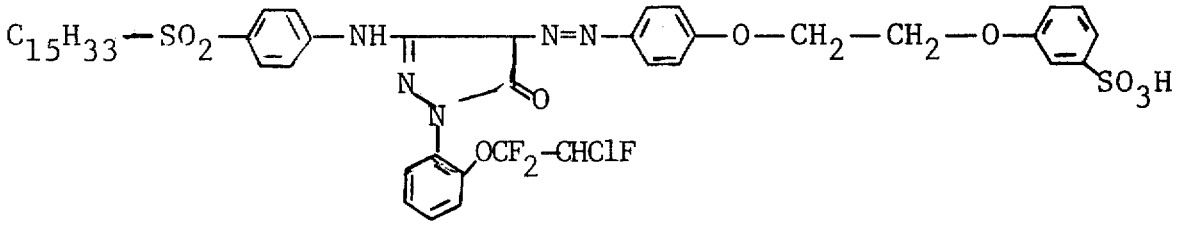

UNITED STATES PATENT AND TRADEMARK OFFICE

CERTIFICATE OF CORRECTION

PATENT NO. : 4,315,070

DATED : February 9, 1982

INVENTOR(S) : Ranz, et al

It is certified that error appears in the above-identified patent and that said Letters Patent is hereby corrected as shown below:

Column 10, the second structural formula in the column and after line 16 should read as follows:

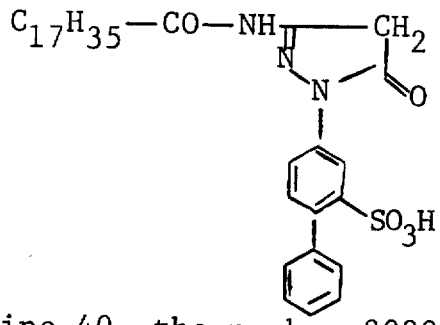

Column 11, line 40, the number 2000 should read -- 20,000 --.

Same column, line 42, the number "5,000" should read -- 50,000 --.

Signed and Sealed this

Tenth Day of May 1983

[SEAL]

Attest:

GERALD J. MOSSINGHOFF

Attesting Officer

Commissioner of Patents and Trademarks